US008106873B2

(12) United States Patent
Cheng et al.

(10) Patent No.: US 8,106,873 B2
(45) Date of Patent: Jan. 31, 2012

(54) GATE PULSE MODULATION CIRCUIT AND LIQUID CRYSTAL DISPLAY THEREOF

(75) Inventors: Hsiao-Chung Cheng, Hsinchu (TW); Tsung-Hung Lee, Hsinchu (TW); Cin-Shun Chen, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 401 days.

(21) Appl. No.: 12/505,636

(22) Filed: Jul. 20, 2009

(65) Prior Publication Data

US 2011/0012891 A1 Jan. 20, 2011

(51) Int. Cl.
*G09G 3/36* (2006.01)

(52) U.S. Cl. ..... 345/99; 345/91

(58) Field of Classification Search ..... 345/87, 345/89–91, 94, 98–100
See application file for complete search history.

(56) References Cited

U.S. PATENT DOCUMENTS

| | | | | |
|---|---|---|---|---|
| 7,557,558 | B2 * | 7/2009 | Barrow | 323/316 |
| 7,652,898 | B2 * | 1/2010 | Kim et al. | 363/49 |
| 2006/0092109 | A1 | 5/2006 | Hsu et al. | |
| 2007/0216632 | A1 | 9/2007 | Lee | |
| 2008/0001887 | A1 | 1/2008 | Hong et al. | |
| 2009/0167654 | A1 * | 7/2009 | Kim et al. | 345/87 |
| 2010/0270803 | A1 * | 10/2010 | Irwin et al. | 290/54 |

* cited by examiner

*Primary Examiner* — Ricardo L Osorio
(74) *Attorney, Agent, or Firm* — Morris Manning & Martin LLP; Tim Tingkang Xia, Esq.

(57) ABSTRACT

The present invention relates to a gate pulse modulation (GPM) circuit and the application of same in a liquid crystal display for improving the display performance thereof. The gate pulse modulation circuit is configured to modulate multi-phase clock pulse signals so as to correspondingly generate odd gate pulse waveforms and even gate pulse waveforms that are different from one another.

17 Claims, 8 Drawing Sheets

GATE PULSE MODULATION CIRCUIT AND LIQUID CRYSTAL DISPLAY THEREOF

FIELD OF THE INVENTION

The present invention relates generally to a liquid crystal display, and more particularly to a gate pulse modulation circuit for improving display performance of the liquid crystal display.

BACKGROUND OF THE INVENTION

A liquid crystal display (LCD) device includes an LCD panel formed with liquid crystal cells and pixel elements with each associating with a corresponding liquid crystal cell and having a liquid crystal (LC) capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals are sequentially applied to the number of pixel rows for sequentially turning on the pixel elements row-by-row. When a scanning signal is applied to a pixel row to turn on corresponding TFTs of the pixel elements of a pixel row, source signals (i.e., image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

To reduce the power consumption, a half source driver (HSD) design is developed. In the HSD design, two neighboring sub-pixel electrodes of different pixels are electrically coupled to the same data line, and two sub-pixel electrodes of a pixel are electrically coupled to two neighboring gate lines, respectively. Such a design may reduce a half of power consumption comparing to a conventional design of an LCD. However, if charging to the sub-pixels is not uniform, dark-bright lines and flicker phenomena would occur when displaying an image, which will compromise the display quality of the LCD.

Therefore, a heretofore unaddressed need exists in the art to address the aforementioned deficiencies and inadequacies.

SUMMARY OF THE INVENTION

In one aspect, the present invention relates to a gate pulse modulation (GPM) circuit usable in a liquid crystal display (LCD). In one embodiment, the GPM circuit includes a low dropout (LDO) regulator, LDO_O, a first resistor, $R_{Cset}$, having a first terminal electrically connected to the LDO regulator LDO_O and a second terminal electrically connected to a node, DTS, respectively, a capacitor, $C_{set}$, having a first terminal electrically connected to the second terminal of the first resistor $R_{Cset}$ and a second terminal electrically connected to the ground, respectively, a switch, SW, have a control terminal, a first terminal electrically connected to the node DTS and a second terminal, and a second resistor, $R_{DTS}$, having a first terminal electrically connected to the second terminal of the switch SW and a second terminal electrically connected to the ground, respectively.

The GPM circuit further includes a comparator having a first input electrically connected to the node DTS, a second input for receiving a voltage signal, Vref, and an output electrically connected to the control terminal of the switch SW, respectively.

The GPM circuit also includes a logic control unit having a first input for receiving N clock signals, {CKj}, j=1, 2, 3, . . . N, N being an even integer greater than zero, a second input electrically connected to the output of the comparator and an output.

Furthermore, the GPM circuit includes a level shifter having N inputs for receiving the N clock signals, {CKj}, respectively, and N outputs for outputting N modulated clock signals, {CKHj}, respectively.

Additionally, the GPM circuit includes N switches, {Sj}, each switch Sj having a control terminal electrically connected to the output of the logic control unit 120, a first terminal electrically connected to a respective output of the level shifter, and a second terminal, a third resistor, $R_O$, having a first terminal electrically connected to the second terminal of each odd switch, Sk, k=1, 3, 5, . . . , N-1, of the N switches {Sj} and a second terminal electrically connected to the ground, respectively, and a fourth resistor, $R_E$, having a first terminal electrically connected to the second terminal of each even switch, Sq, q=2, 4, 6, . . . N, of the N switches {Sj} and a second terminal electrically connected to the ground, respectively.

In one embodiment, each modulated clock signal CKHj of the N modulated clock signals, {CKHj}, j=1, 2, 3, . . . , N, has a waveform that rises from a first voltage, VGL, into a second voltage, VGH, at time, t1; remains at the second voltage VGH until time, t2; falls from the second voltage VGH at time t2 into a third voltage, Vj, at time, t3, at a desired slope; and falls from the third voltage Vj into the first voltage VGL at time t3, and wherein T=(t3−t2) defines a falling time of each modulated clock signal CKHj.

The falling time T=(t3−t2) of each modulated clock signal CKHj, j=1, 2, 3, . . . , N, is a function of the capacitance of the capacitor $C_{set}$. The third voltage Vk of the waveform of each odd modulated clock signal, CKHk, k=1, 3, 5, . . . , N-1, of the N modulated clock signals {CKHj}, j=1, 2, 3, . . . , N, is a function of the resistance of the third resistor $R_O$, and wherein the third voltage Vq of the waveform of each even modulated clock signal, CKHq, q=2, 4, 6, . . . , N, of the N modulated clock signals {CKHj} is a function of the resistance of the fourth resistor $R_E$.

In one embodiment, the resistance of the third resistor $R_O$ is different from the resistance of the fourth resistor $R_E$, and the voltage difference ΔV1=(Vk−VGL) between the third voltage Vk and the first voltage VGL of the waveform of each odd modulated clock signal, CKHk, k=1, 3, 5, . . . , N-1, is different from the voltage difference ΔV2=(Vq−VGL) between the third voltage Vq and the first voltage VGL of the waveform of each even modulated clock signal, CKHq, q=2, 4, 6, . . . , N.

Additionally, the corresponding clock signal CKj has a falling edge at time t2.

In one embodiment, the logic control unit has a CK pulse falling edge detector for receiving each of the N clock signals, {CKj}, j=1, 2, 3, . . . , N, and detecting a falling edge of a waveform of each of the N clock signals, {CKj}, a comparator output detector for receiving an output signal output from the comparator, and a switch ON/OFF controller in communications with the CK pulse falling edge detector and the comparator output detector for turning on or turning off a corresponding switch of the N switches {Sj}, j=1, 2, 3, . . . , N, in accordance with the detected falling edge of the corresponding modulated clock signal by the CK pulse falling edge detector and the detected output signal from the comparator by comparator output detector.

In one embodiment, when the CK pulse falling edge detector detects a falling edge in a clock signal CKj, j=1, 2, 3, . . . , N, (a) the switch ON/OFF controller responsively generates a first signal to turn on the corresponding switch Sj, thereby discharging the corresponding modulated clock signal CKHj output from the j-th output of the level shifter through the third resistor $R_O$ or the fourth resistor $R_E$ to the ground, and (b) the LDO regulator LDO_O provides a current signal passing through the first resistor $R_{Cset}$ to charge the capacitor $C_{set}$, thereby charging the node DTS to have a voltage, $V_{DTS}$.

The comparator compares the voltage $V_{DTS}$ of the DTS node with the reference voltage Vref, wherein when $V_{DTS}$=Vref, the comparator generates an output signal to the comparator output detector to cause the switch ON/OFF controller to generate a second signal to turn off the corresponding switch Sj, and to the control terminal of the switch SW to turn on the switch SW, thereby discharging the voltage $V_{DTS}$ of the node DTS through the second resistor $R_{DTS}$ to the ground.

In another aspect, the present invention relates to an LCD having an LCD panel having a plurality of rows of pixel elements therein and a corresponding plurality of gate lines coupled to the plurality of rows of pixel elements, a GPM circuit for receiving N clock signals {CKj}, j=1, 2, 3, . . . , N, N being an even integer greater than zero, and for outputting N modulated clock signals, {CKHj}, wherein each modulated clock signal CKHj is corresponding to a clock signal CKj and has a waveform having a desired falling slope, and a shift register for receiving the N modulated clock signals {CKHj} and for generating a plurality of gate signals sequentially applied to the plurality of gate lines to drive the plurality of rows of pixel elements.

In one embodiment, the GPM circuit includes an LDO regulator, LDO_O, a first resistor, $R_{Cset}$, having a first terminal electrically connected to the LDO regulator LDO_O and a second terminal electrically connected to a node, DTS, respectively, a capacitor, $C_{set}$, having a first terminal electrically connected to the second terminal of the first resistor $R_{Cset}$ and a second terminal electrically connected to the ground, respectively, a switch, SW, have a control terminal, a first terminal electrically connected to the node DTS and a second terminal, and a second resistor, $R_{DTS}$, having a first terminal electrically connected to the second terminal of the switch SW and a second terminal electrically connected to the ground, respectively.

The GPM circuit further includes a comparator having a first input electrically connected to the node DTS, a second input for receiving a voltage signal, Vref, and an output electrically connected to the control terminal of the comparator, respectively, a logic control unit having a first input for receiving N clock signals, {CKj}, j=1, 2, 3, . . . N, N being an even integer greater than zero, a second input electrically connected to the output of the comparator and an output, and a level shifter having N inputs for receiving the N clock signals, {CKj}, respectively, and N outputs for outputting N modulated clock signals, {CKHj}, respectively.

Furthermore, the GPM circuit includes N switches, {Sj}, each switch Sj having a control terminal electrically connected to the output of the logic control unit 120, a first terminal electrically connected to a respective output of the level shifter, and a second terminal, a third resistor, $R_O$, having a first terminal electrically connected to the second terminal of each odd switch, Sk, k=1, 3, 5, . . . , N-1, of the N switches {Sj} and a second terminal electrically connected to the ground, respectively, and a fourth resistor, $R_E$, having a first terminal electrically connected to the second terminal of each even switch, Sq, q=2, 4, 6, . . . N, of the N switches {Sj} and a second terminal electrically connected to the ground, respectively.

In one embodiment, each modulated clock signal CKHj of the N modulated clock signals, {CKHj}, j=1, 2, 3, . . . , N, has a waveform that rises from a first voltage, VGL, into a second voltage, VGH, at time, t1; remains at the second voltage VGH until time, t2; falls from the second voltage VGH at time t2 into a third voltage, Vj, at time, t3, at a desired slope; and falls from the third voltage Vj into the first voltage VGL at time t3, and wherein T=(t3−t2) defines a falling time of each modulated clock signal CKHj.

The falling time T=(t3−t2) of each modulated clock signal CKHj, j=1, 2, 3, . . . , N, is a function of the capacitance of the capacitor $C_{set}$. The third voltage Vk of the waveform of each odd modulated clock signal, CKHk, k=1, 3, 5, . . . , N-1, of the N modulated clock signals {CKHj}, j=1, 2, 3, . . . , N, is a function of the resistance of the third resistor $R_O$, and wherein the third voltage Vq of the waveform of each even modulated clock signal, CKHq, q=2, 4, 6, . . . , N, of the N modulated clock signals {CKHj} is a function of the resistance of the fourth resistor $R_E$.

In one embodiment, the resistance of the third resistor $R_O$ is different from the resistance of the fourth resistor $R_E$, and the voltage difference ΔV1=(Vk−VGL) between the third voltage Vk and the first voltage VGL of the waveform of each odd modulated clock signal, CKHk, k=1, 3, 5, . . . , N-1, is different from the voltage difference ΔV2=(Vq−VGL) between the third voltage Vq and the first voltage VGL of the waveform of each even modulated clock signal, CKHq, q=2, 4, 6, . . . , N.

Additionally, the corresponding clock signal CKj has a falling edge at time t2. When the clock signal CKj is falling at time t2, (a) the logic control unit generates a first signal to turn on the corresponding switch Sj, thereby discharging the corresponding modulated clock signal CKHj output from the j-th output of the level shifter through the third resistor $R_O$ or the fourth resistor $R_E$ to the ground, and (b) the LDO regulator LDO_O provides a current signal passing through the first resistor $R_{Cset}$ to charge the capacitor $C_{set}$, thereby charging the node DTS to have a voltage, $V_{DTS}$. Meanwhile, the comparator compares the voltage $V_{DTS}$ of the DTS node with the reference voltage Vref, wherein when $V_{DTS}$=Vref, the comparator generates an output signal to the logic control unit to generate a second signal to turn off the corresponding switch Sj, and to the control terminal of the switch SW to turn on the switch SW, thereby discharging the voltage $V_{DTS}$ of the node DTS through the second resistor $R_{DTS}$ to the ground.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
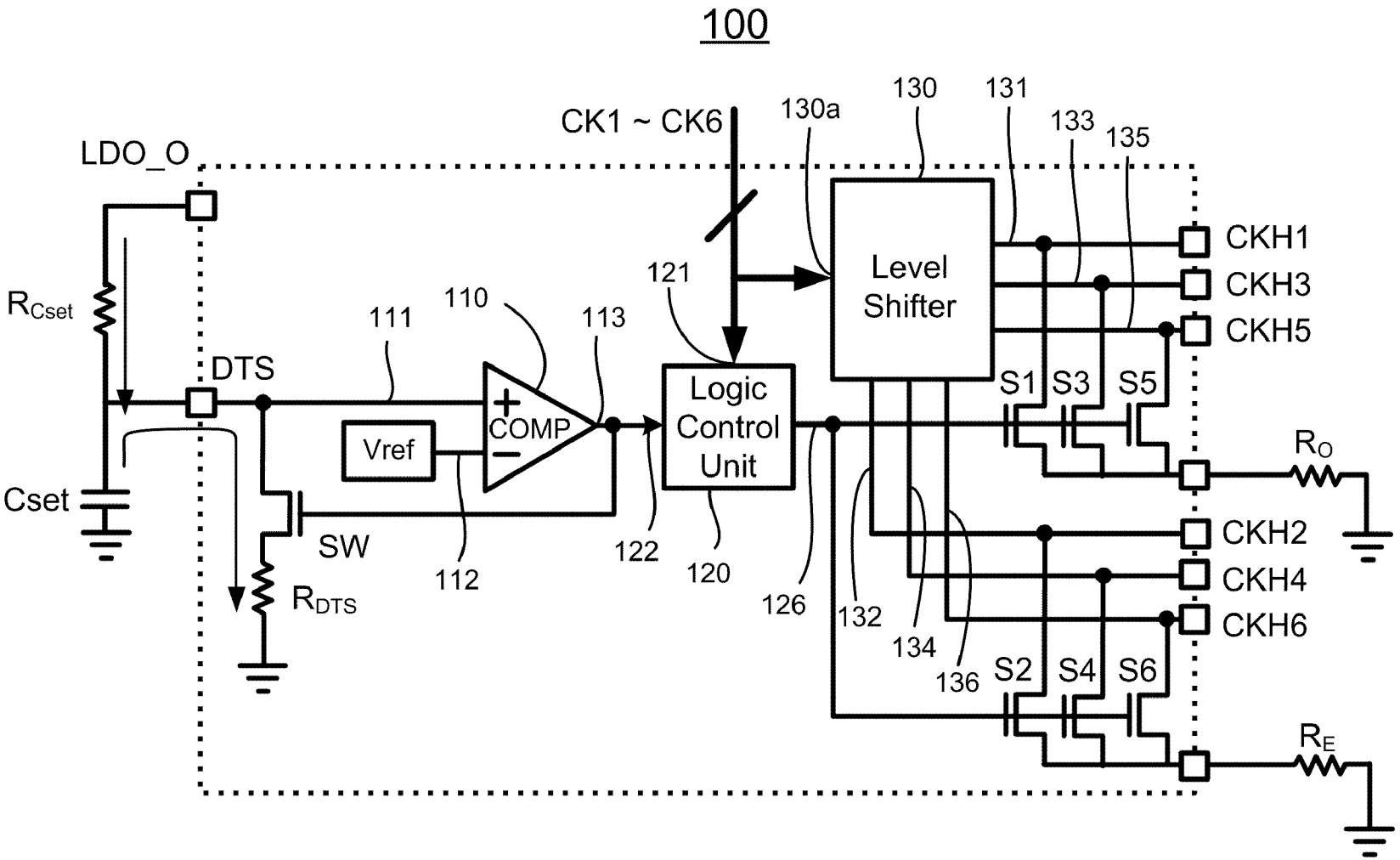
FIG. 1 shows schematically a gate pulse modulation (GPM) circuit according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprise or comprising", "include or including", "have or having", "contain or containing" and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a gate pulse modulation (GPM) circuit usable in a liquid crystal display (LCD).

Referring to FIG. 1, a GPM circuit 100 is shown according to one embodiment of the present invention. The GPM circuit 100 includes a low dropout (LDO) regulator, LDO_O, a capacitor, $C_{set}$, a first resistor, $R_{Cset}$, a second resistor, $R_{DTS}$, and a fourth resistor, $R_E$, a third resistor, $R_O$, a switch device SW, a comparator 110, a logic control unit 120, a level shifter 130, and N switches, {Sj}, j=1, 2, 3, . . . N, N being an even integer greater than zero. In this exemplary embodiment as shown in FIG. 1, N=6, i.e., a six-phase configuration. In one embodiment, the LDO regulator LDO_O is a current source.

As shown in FIG. 1, the first resistor, $R_{Cset}$ has a first terminal electrically connected to the LDO regulator LDO_O and a second terminal electrically connected to a node, DTS, respectively. The capacitor, $C_{set}$, has a first terminal electrically connected to the second terminal of the first resistor $R_{Cset}$ and a second terminal electrically connected to the ground, respectively. The switch device SW has a control terminal, a first terminal electrically connected to the node DTS, and a second terminal. The second resistor $R_{DTS}$ has a first terminal electrically connected to the second terminal of the switch SW and a second terminal electrically connected to the ground, respectively.

The comparator 110 has a first input 111 electrically connected to the node DTS, a second input 112 for receiving a voltage signal, Vref, and an output 113 electrically connected to the control terminal of the switch device SW, respectively.

The level shifter 130 is adapted for converting voltage levels of one or more clock signals into desired voltage levels. In the six-phase configuration, as shown in FIG. 1, the level shifter 130 has an input port 130*a* (or six (6) inputs) for receiving six (6) clock signals CK1, CK2, . . . , CK6, and six (6) outputs 131, 132, . . . , 136 for outputting six corresponding level-shifted clock signals, LS1, LS2, . . . , LS6, respectively. These clock signals CK1, CK2, . . . , CK6 are usually generated by a time controller, TCON. The level-shifted clock signals, LS1, LS2, . . . , LS6 are modulated by the GPM circuit 100 in the form of modulated clock signals, CKH1, CKH2, . . . , CKH6, respectively.

Figure 5:
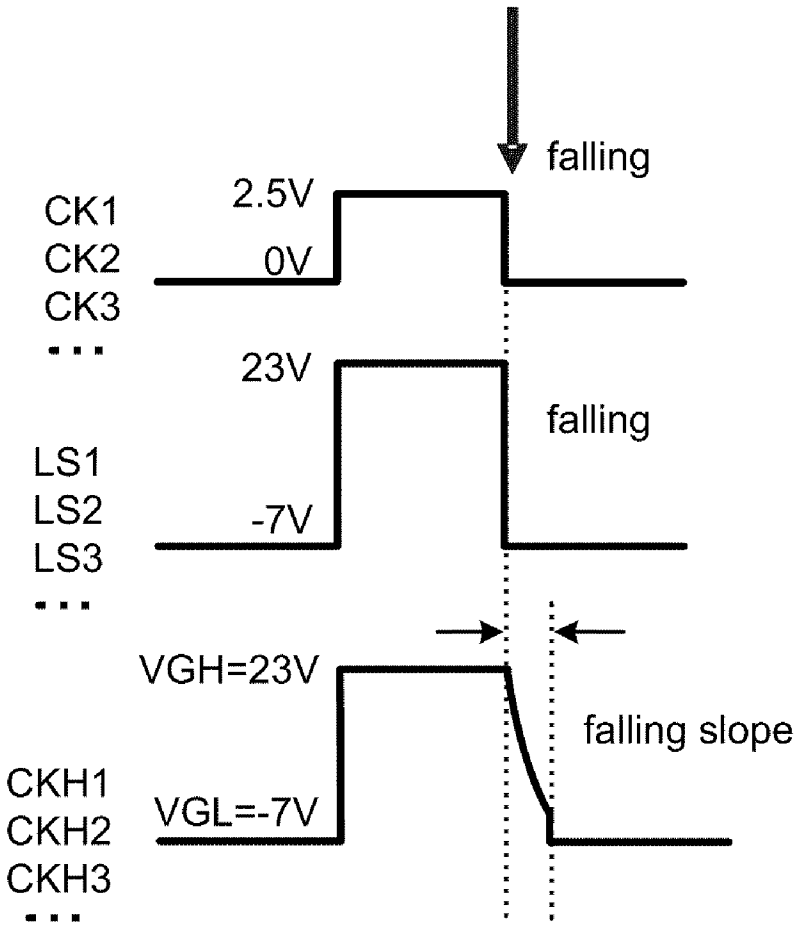
FIG. 5 shows schematically waveforms of a clock signal, a level-shifted clock signal and a modulated clock signal generated by the GPM circuit according to one embodiment of the present invention.

For example, as shown in FIG. 5, each of the clock signals CK1, CK2, . . . , CK6 has a rectangle waveform with a low voltage, 0V, and a high voltage, 2.5V. After the clock signals CK1, CK2, . . . , CK6 are level-shifted by the level shifter, the corresponding level-shifted clock signals LS1, LS2, . . . , LS6 has the same waveform as that of the clock signals CK1, CK2, . . . , CK6, but with the low voltage shifted to −7V and the high voltage shifted to 23V, respectively. Each of the clock signals CK1, CK2, . . . , CK6 and the level-shifted clock signals LS1, LS2, . . . , LS6 has a falling edge. According to the present invention, the level-shifted clock signals LS1, LS2, . . . , LS6 are respectively modulated via a predetermined discharging process as discuss below, such that each of the corresponding modulated clock signals CKH1, CKH2, . . . , CKH6 has a waveform with a desired slope edge. Further, the slope rate for the odd modulated clock signals CKH1, CKH3, CKH5 is different from that for the even modulated clock signals CKH2, CKH4, CKH6.

Referring back to FIG. 1, the logic control unit 120 has a first input port 121 for receiving six (6) clock signals CK1, CK2, . . . , CK6, a second input 122 electrically connected to the output 113 of the comparator 110 and an output 126.

As shown in FIG. 1, in the six-phase configuration, the GPM circuit 100 includes six switches S1, S2, . . . , S6. Each switch has a control terminal electrically connected to the output 126 of the logic control unit 120, a first terminal electrically connected to a respective output 131/132/ . . . /136 of the level shifter 130, and a second terminal. For the odd switches S1, S3, S5, their second terminals are electrically connected to the first terminal of the third resistor $R_O$, which its second terminal is electrically connected to the ground.

For the even switches S2, S4, S6, their second terminals are electrically connected to the first terminal of the fourth resistor $R_E$, which its second terminal is electrically connected to the ground.

Figure 4:
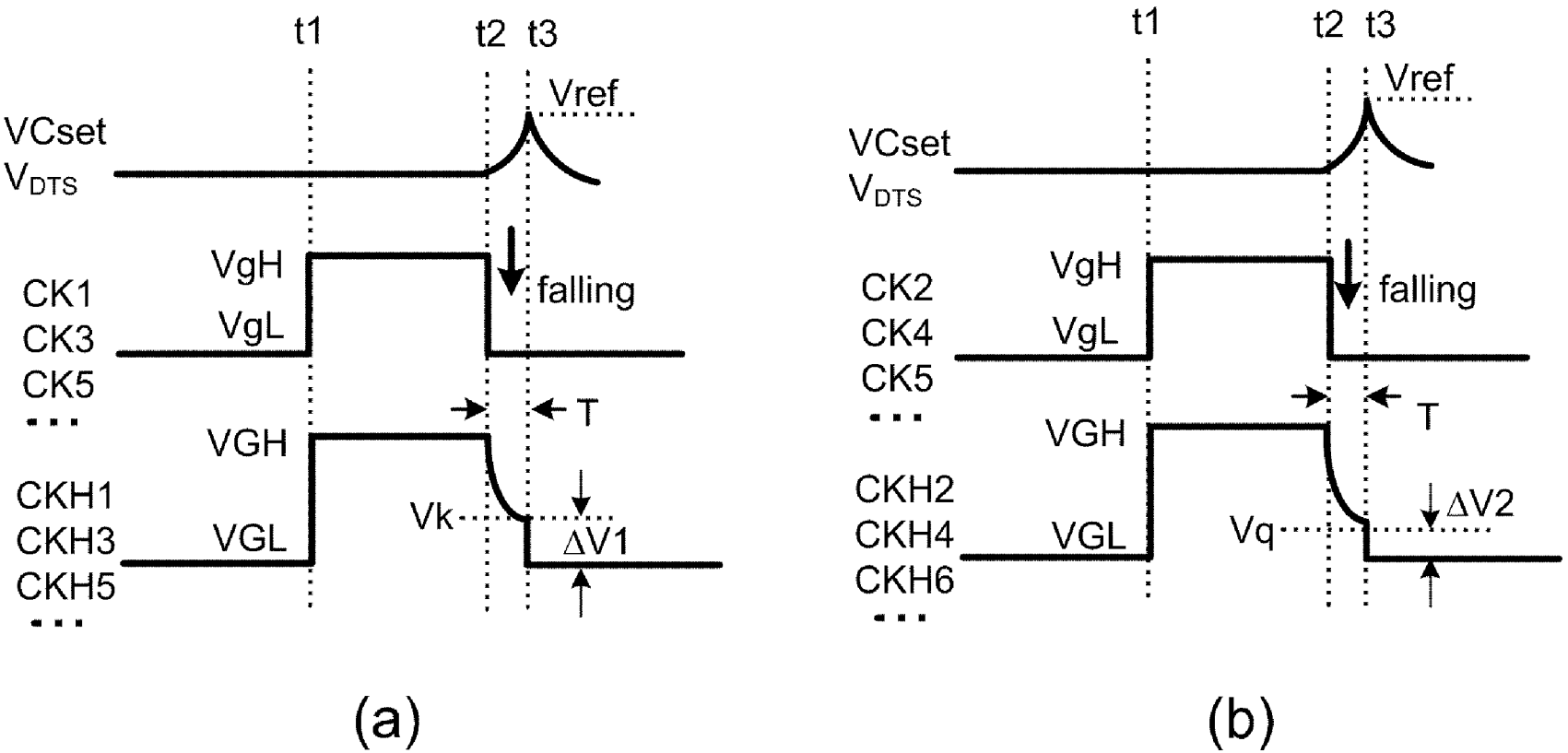
FIG. 4 shows schematically waveforms of the clock signals and the modulated clock signals generated by the GPM circuit according to one embodiment of the present invention, (a) odd channels, and (b) even channels.

For such a configuration of the GPM circuit, as shown in FIG. 4, each modulated clock signal CKH1/CKH2/ . . . / CKH6 has a waveform that rises from a first voltage, VGL, into a second voltage, VGH, at time, t1; remains at the second voltage VGH until time, t2; falls from the second voltage VGH at time t2 into a third voltage, Vj, at time, t3, at a desired slope; and falls from the third voltage Vj into the first voltage VGL at time t3. T=(t3−t2) defines a falling time of each modulated clock signal CKH1/CKH2/ . . . /CKH6, which is a function of the capacitance of the capacitor $C_{set}$. The third voltage Vk of the waveform of each odd modulated clock signal CKH1/CKH3/CKH5 is a function of the resistance of the third resistor $R_O$, while the third voltage Vq of the waveform of each even modulated clock signal CKH2/CKH4/CKH6 is a function of the resistance of the fourth resistor $R_E$. In other words, the voltage difference ΔV1=(Vk−VGL) between the third voltage Vk and the first voltage VGL of the waveform of each odd modulated clock signal CKH1/CKH3/CKH5 is a function of the resistance of the third resistor $R_O$, and the voltage difference ΔV2=(Vq−VGL) between the third voltage Vq and the first voltage VGL of the waveform of each even modulated clock signal CKH2/CKH4/CKH6 is a function of the resistance of the fourth resistor $R_E$. Therefore, according to the present invention, ΔV1 and ΔV2 can have different values by choosing the resistance of the third resistor $R_O$ different from the resistance of the fourth resistor $R_E$.

Figure 2:
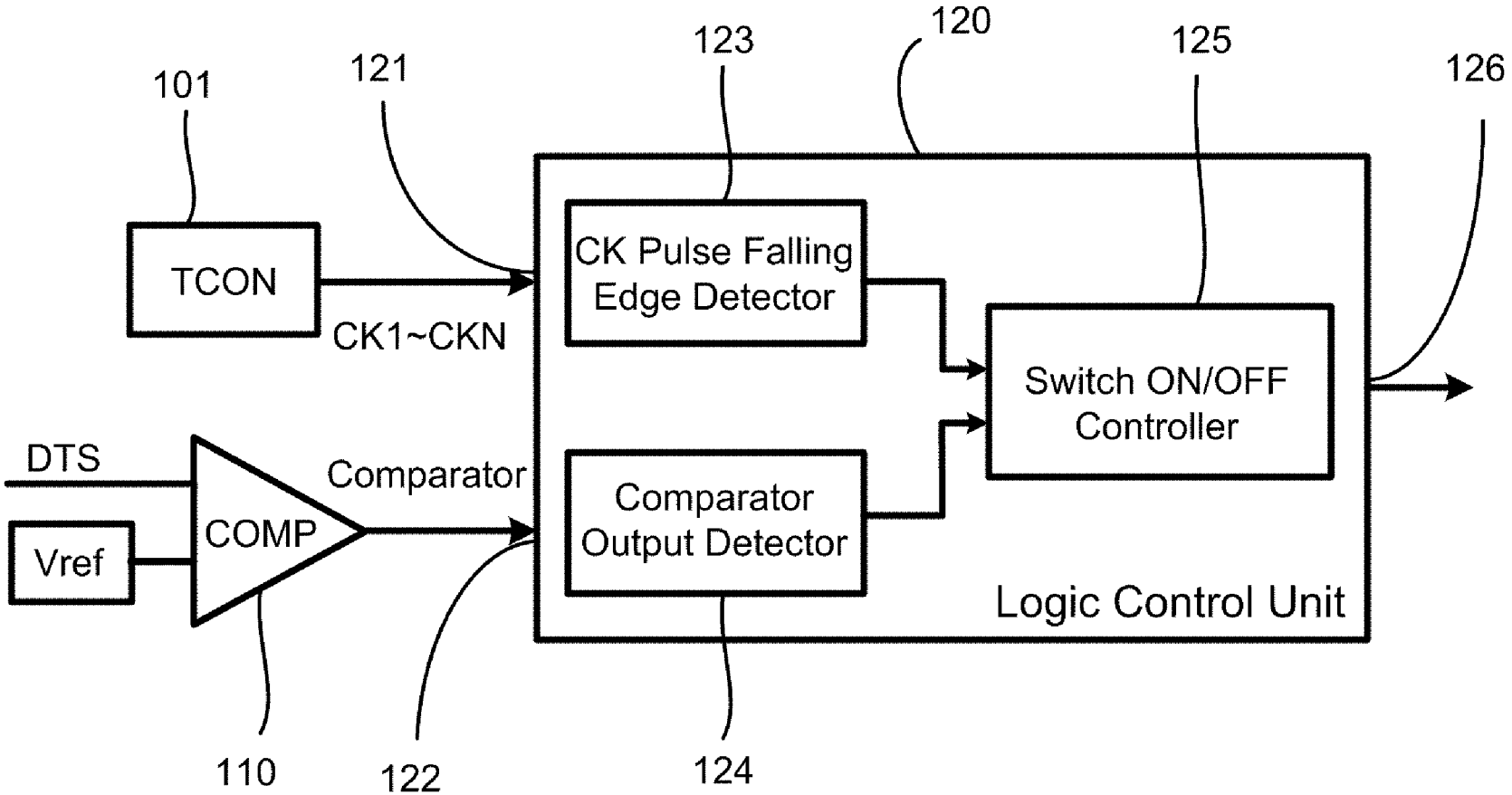
FIG. 2 shows schematically a block diagram of a logic control unit utilized in the GPM circuit according to one embodiment of the present invention.

Referring to FIG. 2, the logic control unit 120 has a CK pulse falling edge detector 123, a comparator output detector 124 and a switch ON/OFF controller 125. The CK pulse falling edge detector 123 is adapted for receiving each of the N clock signals, {CKj}, j=1, 2, 3, . . . , N, generated from the time controller TCON 101, and for detecting a falling edge of a waveform of each of the received N clock signals, {CKj}. The comparator output detector 124 is adapted for receiving an output signal output from the comparator 110. The switch ON/OFF controller 125 in communications with the CK pulse falling edge detector 123 and the comparator output detector 124 is adapted for generating a signal to turn on or turn off a corresponding switch of the N switches {Sj}, j=1, 2, 3, . . . , N, in accordance with the detected falling edge of the corresponding modulated clock signal by the CK pulse falling edge detector 123 and the detected output signal from the comparator by the comparator output detector 124.

Figure 3:
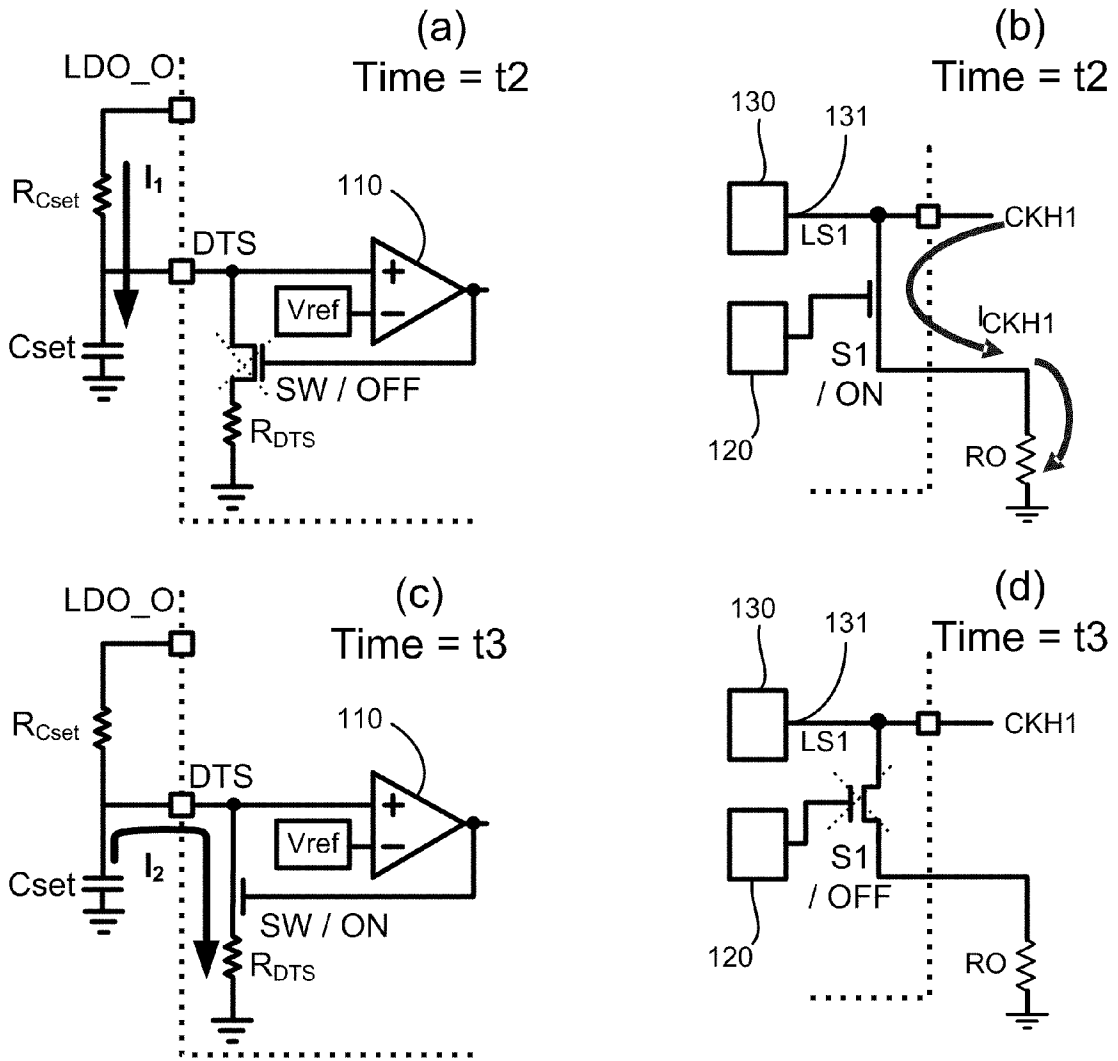
FIG. 3 shows schematically (a)-(d) current flows established at different times in the GPM as shown in FIG. 1.

Specifically, when the CK pulse falling edge detector 123 detects a falling edge at time t2 in the first clock signal CK1, where its voltage level falls from a high voltage, VgH, to a low voltage, VgL, as shown in FIG. 4(*a*), the switch ON/OFF controller 125 responsively generates a first signal to turn on the corresponding switch S1. Accordingly, a current, $I_{CKH1}$, flows from the output 131 of the level shifter 130 through the third resistor $R_O$ to the ground, as shown in FIG. 3(*b*), which discharges the corresponding level-shifted clock signal LS1, thereby causing the modulated clock signal CKH1 to decrease from the second voltage VGH with a falling slope. Meanwhile, the LDO regulator LDO_O provides a current signal, $I_1$, passing through the first resistor $R_{Cset}$ to charge the capacitor $C_{set}$, thereby charging the node DTS to have a voltage, $V_{DTS}$, as shown in FIG. 3(*a*).

Then, the comparator 110 compares the voltage $V_{DTS}$ of the DTS node with the reference voltage Vref. When $V_{DTS}$=Vref at time t3, as shown in FIG. 4(*a*), the comparator 110 generates an output signal to the comparator output detector 124 to cause the switch ON/OFF controller 125 to generate a second signal to turn off the corresponding switch S1, as shown in FIG. 3(*d*), where no current flows from the output 131 of the level shifter 130 through the third resistor $R_O$ to the ground. Accordingly, the modulated clock signal CKH1 decreases to the third level Vk at time t3, as shown in FIG. 4(*a*). Meanwhile, the generated output signal is applied to the control terminal of the switch device SW to turn on the switch device SW, so that a current, $I_2$, flows from the node DTS through the second resistor $R_{DTS}$ to the ground, thereby discharging the voltage $V_{DTS}$ of the node DTS through the second resistor $R_{DTS}$ to the ground, as shown in FIG. 3(*c*). Preferably, the voltage $V_{DTS}$ of the node DTS is discharged to zero prior to the next cycle of the processes. The charging time T=(t3−t2) of the capacitor $C_{set}$ from zero to Vref is the falling slope time of the modulated clock signal CKH1 from the second voltage VGH to the third level Vk. The charging time T=(t3−t2) of the capacitor $C_{set}$ can be adjusted by setting up the voltage value of Vref. The third voltage Vk is determined by the resistance of the third resistor $R_O$ and the charging time T of the capacitor $C_{set}$.

The above processes are repeated for obtaining the other modulated clock signals, CKH2, CKH3, . . . , CKH(N-1). For the even modulated clock signals, CKH2, CKH4, . . . , CKHN, the third voltage Vq is determined by the resistance of the fourth resistor $R_E$ and the charging time T of the capacitor $C_{set}$.

Figure 6:
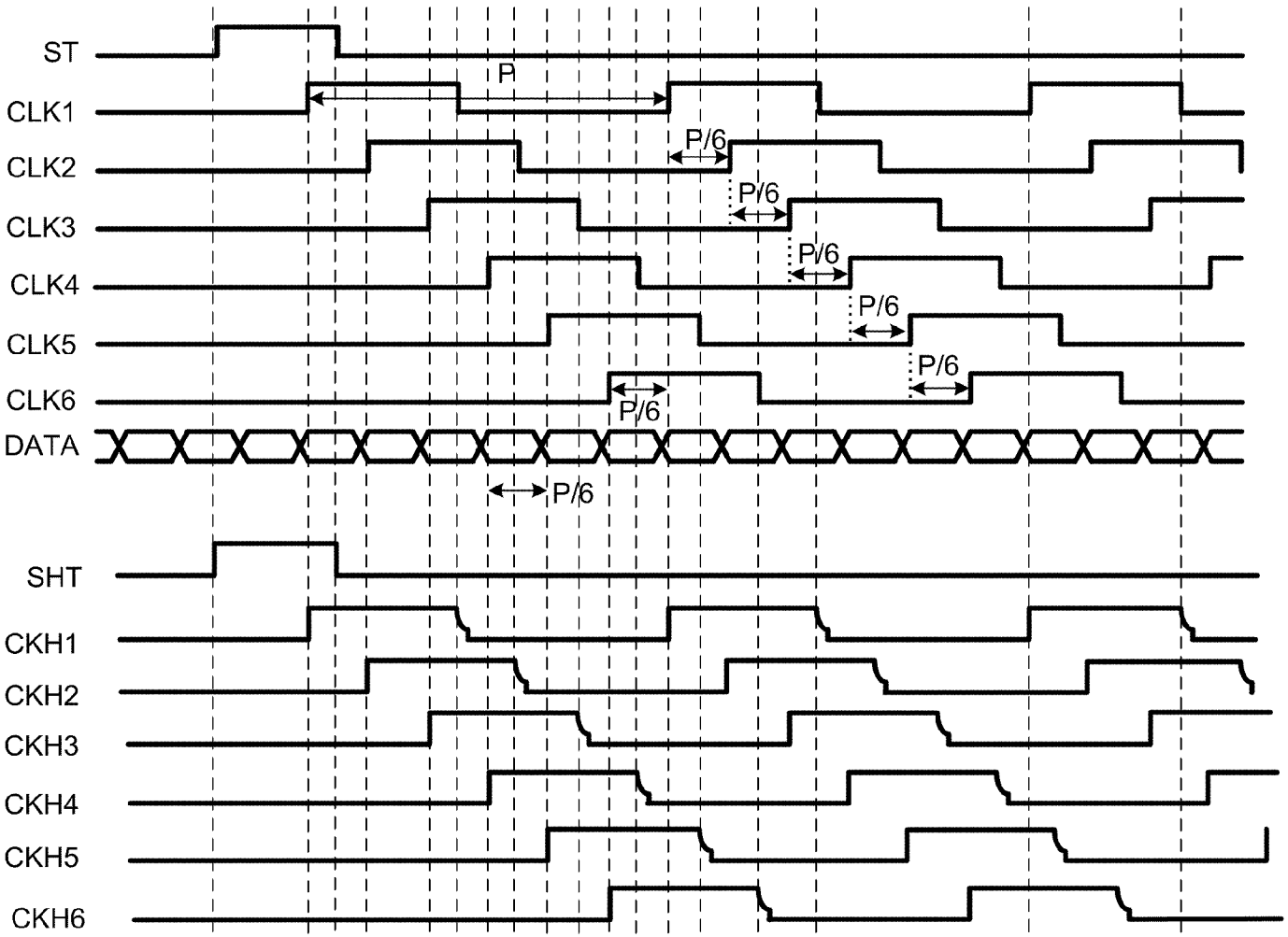
FIG. 6 shows schematically waveforms of clock signals and modulated clock signals generated by the GPM circuit according to one embodiment of the present invention.

FIG. 6 shows time charts of six clock signals CK1, CK2, . . . , CK6, and the corresponding modulated clock signals CKH1, CKH2, . . . , CKH6 generated from a six-phase GPM circuit according to the present invention. Each waveform of the modulated clock signals CKH1, CKH2, . . . , CKH6 has a falling slope starting at the time when the waveform of the corresponding clock signal falls.

Figure 7:
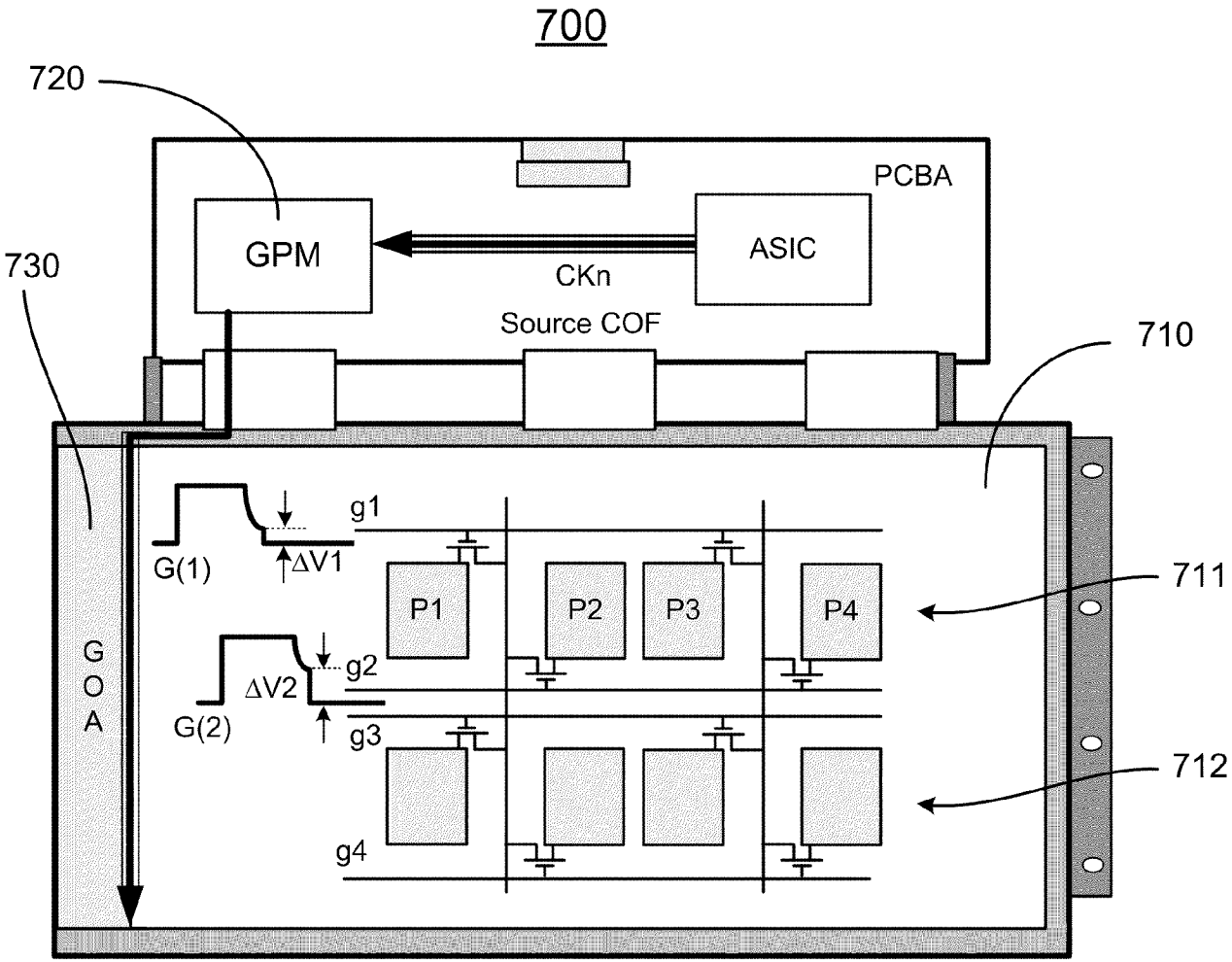
FIG. 7 shows schematically a block diagram of an LCD according to one embodiment of the present invention.
Figure 8:
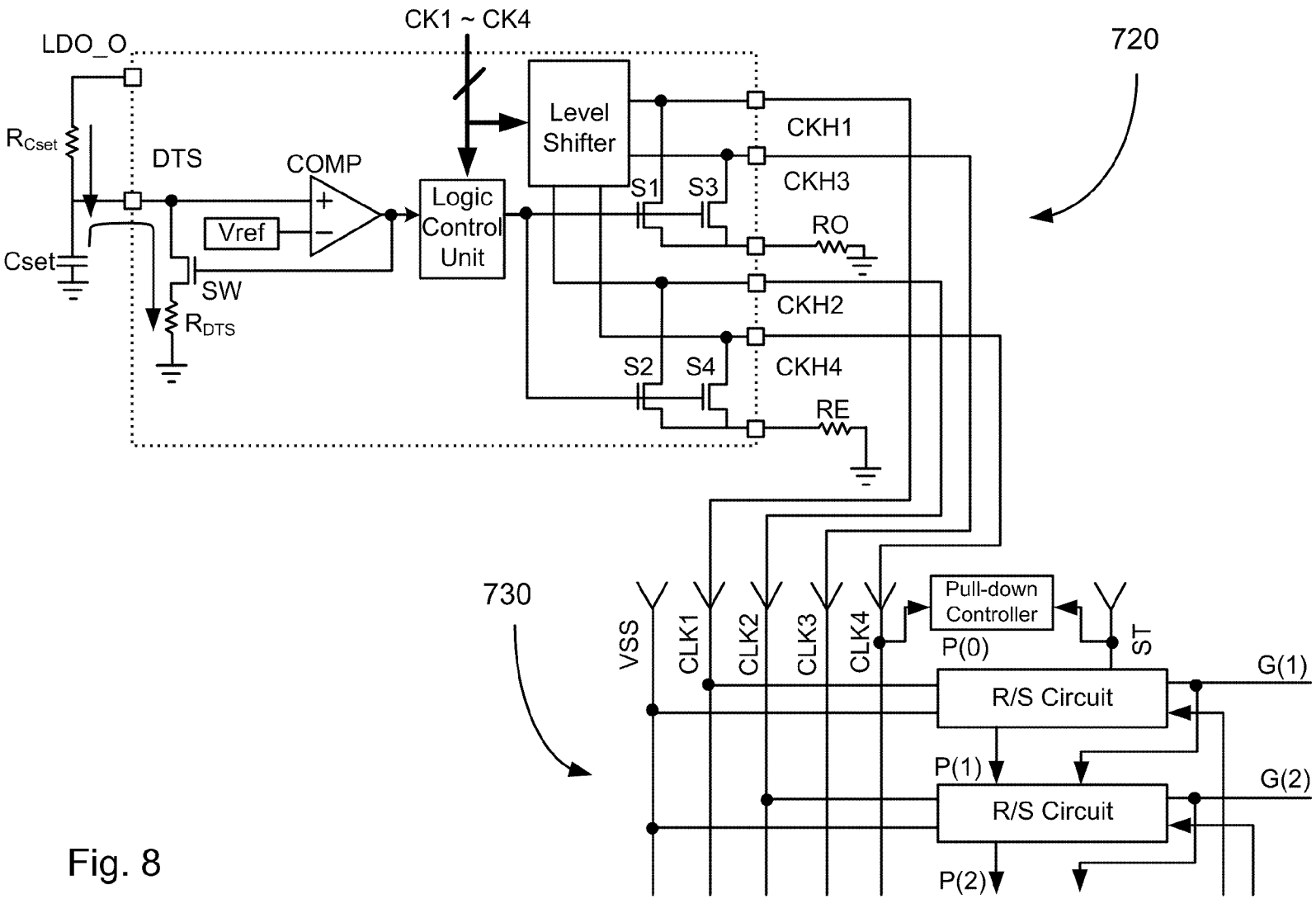
FIG. 8 shows schematically a GPM circuit and a shift register utilized in an LCD according to one embodiment of the present invention.

FIGS. 7 and 8 show an LCD 700 that utilizes a GPM circuit 720 to modulate odd gate pulse waveforms and even gate pulse waveforms according to one embodiment of the present invention.

The LCD 700 has an LCD panel 710 having a plurality of rows of pixel elements 711 and 712 therein and a corresponding plurality of gate lines g1, g2, g3, g4, electrically coupled to the plurality of rows of pixel elements 711 and 712. For the purpose of illustration of the invention, only two rows of pixel elements 711 and 712 and four gate lines g1, g2, g3, g4 are shown in this exemplary embodiment. The LCD 700 also has a GPM circuit 720 for receiving four clock signals CK1, CK2, CK3, CK4, and for outputting four modulated clock signals CKH1, CKH2, CKH3, CKH4. Each modulated clock signal CKH1/CKH2/CKH3/CKH4 is corresponding to a clock signal CK1/CK2/CK3/CK4 and has a waveform having a desired falling slope. The details of the GPM circuit 720 is same as that of the GPM circuit 100, as shown in FIG. 1 and discussed above, except in the embodiment, a four-phase configuration is utilized. The modulated clock signals CKH1, CKH2, CKH3, CKH4 are input to a shift register 730 formed on a glass substrate of the LCD panel 710, i.e., the gate on array (GOA). The shift register 730 responsively generates a plurality of gate signals G(1), G(2), . . . , According to the present invention, the waveforms of the odd gate signals and of the even gate signals are different. When the plurality of gate signals G(1), G(2), . . . , is sequentially applied to the plurality of gate lines g1, g2, . . . , to drive the plurality of rows of pixel elements 711 and 712, the odd gate lines and the even gate lines have different feed-through effects, thereby minimizing the dark-bright line and flicker phenomena associated with the HSD pixel design and improving display performance of the LCD.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A gate pulse modulation (GPM) circuit usable in a liquid crystal display (LCD), comprising:

(a) a low dropout (LDO) regulator, LDO_O;

(b) a first resistor, $R_{Cset}$, having a first terminal electrically connected to the LDO regulator LDO_O and a second terminal electrically connected to a node, DTS, respectively;

(c) a capacitor, $C_{set}$, having a first terminal electrically connected to the second terminal of the first resistor $R_{Cset}$ and a second terminal electrically connected to the ground, respectively;

(d) a switch, SW, have a control terminal, a first terminal electrically connected to the node DTS and a second terminal;

(e) a second resistor, $R_{DTS}$, having a first terminal electrically connected to the second terminal of the switch SW and a second terminal electrically connected to the ground, respectively;

(f) a comparator having a first input electrically connected to the node DTS, a second input for receiving a voltage signal, Vref, and an output electrically connected to the control terminal of the switch SW, respectively;

(g) a level shifter having N inputs for receiving N clock signals, {CKj}, respectively, and N outputs for outputting N modulated clock signals, {CKHj}, respectively, j=1, 2, 3, . . . N, N being an even integer greater than zero;

(h) a logic control unit having a first input for receiving the N clock signals, {CKj}, a second input electrically connected to the output of the comparator and an output;

(i) N switches, {Sj}, each switch Sj having a control terminal electrically connected to the output of the logic control unit, a first terminal electrically connected to a respective output of the level shifter, and a second terminal;

(j) a third resistor, $R_O$, having a first terminal electrically connected to the second terminal of each odd switch, Sk, k=1, 3, 5, . . . , N-1, of the N switches {Sj} and a second terminal electrically connected to the ground, respectively; and (k) a fourth resistor, $R_E$, having a first terminal electrically connected to the second terminal of each even switch, Sq, q=2, 4, 6, . . . N, of the N switches {Sj} and a second terminal electrically connected to the ground, respectively.

2. The GPM circuit of claim 1, wherein each modulated clock signal CKHj of the N modulated clock signals, {CKHj}, j=1, 2, 3, . . . , N, has a waveform that rises from a first voltage, VGL, into a second voltage, VGH, at time, t1; remains at the second voltage VGH until time, t2; falls from the second voltage VGH at time t2 into a third voltage, Vj, at time, t3, at a desired slope; and falls from the third voltage Vj into the first voltage VGL at time t3, and wherein T=(t3−t2) defines a falling time of each modulated clock signal CKHj.

3. The GPM circuit of claim 2, wherein the corresponding clock signal CKj has a falling edge at time t2.

4. The GPM circuit of claim 2, wherein the falling time T=(t3−t2) of each modulated clock signal CKHj, j=1, 2, 3, . . . , N, is a function of the capacitance of the capacitor $C_{set}$.

5. The GPM circuit of claim 4, wherein the third voltage Vk of the waveform of each odd modulated clock signal, CKHk, k=1, 3, 5, . . . , N-1, of the N modulated clock signals {CKHj}, j=1, 2, 3, . . . , N, is a function of the resistance of the third resistor $R_O$, and wherein the third voltage Vq of the waveform of each even modulated clock signal, CKHq, q=2, 4, 6, . . . , N, of the N modulated clock signals {CKHj} is a function of the resistance of the fourth resistor $R_E$.

6. The GPM circuit of claim 5, wherein the resistance of the third resistor $R_O$ is different from the resistance of the fourth resistor $R_E$, and wherein the voltage difference ΔV1=(Vk−VGL) between the third voltage Vk and the first voltage VGL of the waveform of each odd modulated clock signal, CKHk, k=1, 3, 5, . . . , N-1, is different from the voltage difference ΔV2=(Vq−VGL) between the third voltage Vq and the first voltage VGL of the waveform of each even modulated clock signal, CKHq, q=2, 4, 6, . . . , N.

7. The GPM circuit of claim 1, wherein the logic control unit comprises:

(a) a CK pulse falling edge detector for receiving each of the N clock signals, {CKj}, j=1, 2, 3, . . . , N, and detecting a falling edge of a waveform of each of the N clock signals, {CKj};

(b) a comparator output detector for receiving an output signal output from the comparator; and (c) a switch ON/OFF controller in communications with the CK pulse falling edge detector and the comparator output detector for turning on or turning off a corresponding switch of the N switches {Sj}, j=1, 2, 3, . . . , N, in accordance with the detected falling edge of the corresponding modulated clock signal by the CK pulse falling edge detector and the detected output signal from the comparator by comparator output detector.

8. The GPM circuit of claim 7, wherein when the CK pulse falling edge detector detects a falling edge in a clock signal CKj, j=1, 2, 3, . . . , N, (a) the switch ON/OFF controller responsively generates a first signal to turn on the corresponding switch Sj, thereby discharging the corresponding modulated clock signal CKHj output from the j-th output of the level shifter through the third resistor $R_O$ or the fourth resistor $R_E$ to the ground; and (b) the LDO regulator LDO_O provides a current signal passing through the first resistor $R_{Cset}$ to charge the capacitor $C_{set}$, thereby charging the node DTS to have a voltage, $V_{DTS}$.

9. The GPM circuit of claim 8, wherein the comparator compares the voltage $V_{DTS}$ of the DTS node with the reference voltage Vref, wherein when $V_{DTS}$=Vref, the comparator generates an output signal to (a) the comparator output detector to cause the switch ON/OFF controller to generate a second signal to turn off the corresponding switch Sj; and (b) the control terminal of the switch SW to turn on the switch SW, thereby discharging the voltage $V_{DTS}$ of the node DTS through the second resistor $R_{DTS}$ to the ground.

10. A liquid crystal display (LCD), comprising:

(a) an LCD panel having a plurality of rows of pixel elements therein and a corresponding plurality of gate lines coupled to the plurality of rows of pixel elements;

(b) a gate pulse modulation (GPM) circuit for receiving N clock signals {CKj}, j=1, 2, 3, . . . , N, N being an even integer greater than zero, and for outputting N modulated clock signals, {CKHj}, wherein each modulated clock signal CKHj is corresponding to a clock signal CKj and has a waveform having a desired falling slope; and (c) a shift register for receiving the N modulated clock signals {CKHj} and for generating a plurality of gate signals sequentially applied to the plurality of gate lines to drive the plurality of rows of pixel elements, wherein the gate pulse modulation (GPM) circuit comprises:

(i) a low dropout (LDO) regulator, LDO_O;

(ii) a first resistor, $R_{Cset}$, having a first terminal electrically connected to the LDO regulator LDO_0 and a second terminal electrically connected to a node, DTS, respectively;

(iii) a capacitor, $C_{set}$, having a first terminal electrically connected to the second terminal of the first resistor $R_{Cset}$ and a second terminal electrically connected to the ground, respectively;

(iv) a switch, SW, have a control terminal, a first terminal electrically connected to the node DTS and a second terminal;

(v) a second resistor, $R_{DTS}$, having a first terminal electrically connected to the second terminal of the switch SW and a second terminal electrically connected to the ground, respectively;

(vi) a comparator having a first input electrically connected to the node DTS, a second input for receiving a voltage signal, Vref, and an output electrically connected to the control terminal of the comparator, respectively;

(vii) a level shifter having N inputs for receiving the N clock signals, {CKj}, respectively, and N outputs for outputting the N modulated clock signals, {CKHj}, respectively, j=1, 2, 3, . . . N, N being an even integer greater than zero;

(viii) a logic control unit having a first input for receiving the N clock signals, {CKj}, a second input electrically connected to the output of the comparator and an output;

(ix) N switches, {Sj}, each switch Sj having a control terminal electrically connected to the output of the logic control unit, a first terminal electrically connected to a respective output of the level shifter, and a second terminal;

(x) a third resistor, $R_O$, having a first terminal electrically connected to the second terminal of each odd switch, Sk, k=1, 3, 5, . . . , N-1, of the N switches {Sj} and a second terminal electrically connected to the ground, respectively; and (xi) a fourth resistor, $R_E$, having a first terminal electrically connected to the second terminal of each even switch, Sq, q=2, 4, 6, . . . N, of the N switches {Sj} and a second terminal electrically connected to the ground, respectively.

11. The LCD of claim 10, wherein the waveform of each modulated clock signal CKHj of the N modulated clock signals, {CKHj}, j=1, 2, 3, . . . , N, rises from a first voltage, VGL, into a second voltage, VGH, at time, t1; remains at the second voltage VGH until time, t2; falls from the second voltage VGH at time t2 into a third voltage, Vj, at time, t3, at a desired slope; and falls from the third voltage Vj into the first voltage VGL at time t3, and wherein T=(t3−t2) defines a falling time of each modulated clock signal CKHj.

12. The LCD of claim 11, wherein the falling time T=(t3−t2) of each modulated clock signal CKHj, j=1, 2, 3, . . . , N, is a function of the capacitance of the capacitor $C_{set}$.

13. The LCD of claim 12, wherein the third voltage Vk of the waveform of each odd modulated clock signal, CKHk, k=1, 3, 5, . . . , N-1, of the N modulated clock signals {CKHj}, j=1, 2, 3, . . . , N, is a function of the resistance of the third resistor $R_O$, and wherein the third voltage Vq of the waveform of each even modulated clock signal, CKHq, q=2, 4, 6, . . . , N, of the N modulated clock signals {CKHj} is a function of the resistance of the fourth resistor $R_E$.

14. The LCD of claim 13, wherein the resistance of the third resistor $R_O$ is different from the resistance of the fourth resistor $R_E$, and wherein the voltage difference ΔV1=(Vk−VGL) between the third voltage Vk and the first voltage VGL of the waveform of each odd modulated clock signal, CKHk, k=1, 3, 5, . . . , N-1, is different from the voltage difference ΔV2=(Vq−VGL) between the third voltage Vq and the first voltage VGL of the waveform of each even modulated clock signal, CKHq, q=2, 4, 6, . . . , N.

15. The LCD of claim 11, wherein the clock signal CKj has a falling edge at time t2.

16. The LCD of claim 15, wherein when the clock signal CKj is falling at time t2, (c) the logic control unit generates a first signal to turn on the corresponding switch Sj, thereby discharging the corresponding modulated clock signal CKHj output from the j-th output of the level shifter through the third resistor $R_O$ or the fourth resistor $R_E$ to the ground; and (d) the LDO regulator LDO_O provides a current signal passing through the first resistor $R_{Cset}$ to charge the capacitor $C_{set}$, thereby charging the node DTS to have a voltage, $V_{DTS}$.

17. The LCD of claim 16, wherein the comparator compares the voltage $V_{DTS}$ of the DTS node with the reference voltage Vref, wherein when $V_{DTS}$=Vref, the comparator generates an output signal to (c) the logic control unit to generate a second signal to turn off the corresponding switch Sj; and (d) the control terminal of the switch SW to turn on the switch SW, thereby discharging the voltage $V_{DTS}$ of the node DTS through the second resistor $R_{DTS}$ to the ground.

* * * * *